US008047174B2

(12) United States Patent
Iwasaki et al.

(10) Patent No.: US 8,047,174 B2
(45) Date of Patent: Nov. 1, 2011

(54) INTERNAL COMBUSTION ENGINE COMPONENT AND METHOD FOR PRODUCING THE SAME

(75) Inventors: Shinya Iwasaki, Shizuoka (JP); Hiroshi Yamagata, Shizuoka (JP); Hirotaka Kurita, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 641 days.

(21) Appl. No.: 12/282,015

(22) PCT Filed: Dec. 25, 2007

(86) PCT No.: PCT/JP2007/075362

§ 371 (c)(1),
(2), (4) Date: Sep. 8, 2008

(87) PCT Pub. No.: WO2008/081964

PCT Pub. Date: Jul. 10, 2008

(65) Prior Publication Data

US 2009/0151689 A1 Jun. 18, 2009

(30) Foreign Application Priority Data

Dec. 28, 2006 (JP) ..... 2006-354551

(51) Int. Cl.
*F01L 3/00* (2006.01)

(52) U.S. Cl. ..... 123/188.11; 123/193.6

(58) Field of Classification Search ..... 123/188.11, 123/193.6

See application file for complete search history.

(56) References Cited

U.S. PATENT DOCUMENTS

| | | | | |
|---|---|---|---|---|
| RE27,081 | E | 3/1971 | Shockley et al. | |
| 3,896,009 | A | 7/1975 | Kobayashi et al. | |
| 6,205,836 | B1 | 3/2001 | Yamagata et al. | |
| 6,309,480 | B1 | 10/2001 | Ruckert et al. | |
| 7,412,955 | B2 * | 8/2008 | Kurita et al. | 123/188.11 |
| 7,765,977 | B2 * | 8/2010 | Kurita et al. | 123/195 R |
| 2006/0150941 | A1 * | 7/2006 | Verbrugge et al. | 123/193.6 |

FOREIGN PATENT DOCUMENTS

| | | | |
|---|---|---|---|
| JP | 04-189465 | A | 7/1992 |
| JP | 08-000987 | B2 | 1/1996 |
| JP | 2885407 | B2 | 4/1999 |
| JP | 2002-138896 | A | 5/2002 |
| JP | 2004-268179 | A | 9/2004 |
| WO | 2004/002658 | A1 | 1/2004 |
| WO | 2005/083253 | A1 | 9/2005 |

OTHER PUBLICATIONS

Official Communication issued in International Patent Application No. PCT/JP2007/075362, mailed on Apr. 18, 2008.

Jorstad, "Reynolds 390 Engine Technology," SAE Technical Paper Series, Mar. 4, 1983, pp. 1-5.

* cited by examiner

*Primary Examiner* — Michael Cuff
*Assistant Examiner* — James Kim
(74) *Attorney, Agent, or Firm* — Keating & Bennett, LLP

(57) ABSTRACT

An internal combustion engine component is composed of an aluminum alloy containing silicon, and includes a plurality of silicon crystal grains located on a slide surface. The slide surface has a ten point-average roughness $Rz_{JIS}$ of about 0.54 μm or more, and a load length ratio Rmr(30) at a cut level of about 30% of the slide surface is about 20% or more.

12 Claims, 13 Drawing Sheets

INTERNAL COMBUSTION ENGINE COMPONENT AND METHOD FOR PRODUCING THE SAME

BACKGROUND OF THE INVENTION

1. Field of the Invention

The present invention relates to an internal combustion engine component, e.g., a cylinder block or a piston, and a method for producing the same. More particularly, the present invention relates to an internal combustion engine component composed of an aluminum alloy which includes silicon, and a method for producing the same. The present invention also relates to an internal combustion engine and a transportation apparatus incorporating such an internal combustion engine component.

2. Description of the Related Art

In recent years, in an attempt to reduce the weight of internal combustion engines, there has been a trend to use an aluminum alloy for cylinder blocks. Since a cylinder block is required to have a high strength and high abrasion resistance, aluminum alloys which contain a large amount of silicon, i.e., aluminum-silicon alloys having a hypereutectic composition, are expected to be promising aluminum alloys for cylinder blocks.

In a cylinder block composed of an aluminum-silicon alloy, silicon crystal grains located on the slide surface will contribute to the improvement of strength and abrasion resistance. An example of a technique for obtaining silicon crystal grains exposed on the surface of an alloy matrix is a honing process for allowing silicon crystal grains to remain jutting (called "emboss honing"). Moreover, Japanese Patent No. 2885407 discloses a technique of performing an etching process for allowing silicon crystal grains to remain jutting on the surface of an aluminum-silicon alloy, and thereafter performing an anodic oxidation to form an oxide layer, and further flame spraying a fluoroplastic onto this oxide layer to form a fluoroplastic resin layer.

Since a lubricant is retained in between the silicon crystal grains which remain jutting on the slide surface (i.e., in the recesses between the silicon crystal grains functioning as oil puddles), an improved lubricity is obtained when a piston slides within the cylinder, whereby the abrasion resistance and burn-up resistance of the cylinder block are improved.

However, the inventors have found that further improvements in abrasion resistance and burn-up resistance become necessary when using the above-described aluminum-alloy cylinder block for certain types of internal combustion engines.

Conventionally, aluminum-alloy cylinder blocks have been used in internal combustion engines that are mounted in four-wheeled automobiles. In a four-wheeled automobile, a mechanism (e.g., an oil pump) for compulsorily supplying a lubricant for the cylinder block and piston is provided in the internal combustion engine, and the internal combustion engine is operated at a relatively low revolution speed (specifically, under a maximum revolution speed of 7500 rpm or less), in which case the aforementioned problems will not occur. However, in an internal combustion engine which is operated at a relatively high revolution speed (specifically, under a maximum revolution speed of 8000 rpm or less), or in an internal combustion engine in which a lubricant is supplied to the cylinder only by way of splashing of the lubricant associated with crankshaft rotation (i.e., the oil pump is omitted, as in the case of an internal combustion engine that is mounted in a motorcycle), the aluminum-alloy cylinder block may experience burn-up and/or significant abrasion. Moreover, when an aluminum alloy is used as the piston material in order to achieve a further mass reduction, there is an increased likelihood of burn-up.

In order to further improve the abrasion resistance and burn-up resistance of the cylinder block, it is necessary to improve the lubricity at the start of the internal combustion engine, which requires good retention of lubricant on the slide surface. The inventors have found through their study that a cylinder block which has been subjected to the aforementioned emboss honing process or etching process cannot achieve a sufficient lubricant retention, so that less than adequate lubricity exists when a high-speed operation is reached immediately after the start of the internal combustion engine.

SUMMARY OF THE INVENTION

In order to solve the aforementioned problems, preferred embodiments of the present invention provide an internal combustion engine component with a slide surface which has a good lubricant-retaining ability, and a method for producing the same.

An internal combustion engine component according to a preferred embodiment of the present invention is an internal combustion engine component composed of an aluminum alloy containing silicon, including: a plurality of silicon crystal grains located on a slide surface, wherein the slide surface has a ten point-average roughness $Rz_{JIS}$ of about 0.54 μm or more, and a load length ratio Rmr(30) at a cut level of about 30% of the slide surface is about 20% or more.

In a preferred embodiment, the plurality of silicon crystal grains include a plurality of primary-crystal silicon grains and a plurality of eutectic silicon grains.

In a preferred embodiment, the plurality of primary-crystal silicon grains have an average crystal grain size of no less than 12 μm and no more than about 50 μm.

In a preferred embodiment, the plurality of eutectic silicon grains have an average crystal grain size of about 7.5 μm or less.

In a preferred embodiment, the plurality of silicon crystal grains have a grain size distribution having a first peak existing in a crystal grain size range of no less than about 1 μm and no more than about 7.5 μm and a second peak existing in a crystal grain size range of no less than about 12 μm and no more than about 50 μm.

In a preferred embodiment, a frequency at the first peak is at least about five times greater than a frequency at the second peak.

In a preferred embodiment, the aluminum alloy contains: no less than about 73.4 mass % and no more than about 79.6 mass % of aluminum; no less than about 18 mass % and no more than about 22 mass % of silicon; and no less than about 2.0 mass % and no more than about 3.0 mass % of copper.

In a preferred embodiment, the aluminum alloy contains no less than about 50 mass ppm and no more than about 200 mass ppm of phosphorus and no more than about 0.01 mass % of calcium.

In a preferred embodiment, an internal combustion engine component according to the present invention is a cylinder block.

An internal combustion engine according to another preferred embodiment of the present invention includes an internal combustion engine component having the aforementioned construction.

In a preferred embodiment, the internal combustion engine according to the present invention includes a piston composed of an aluminum alloy; and the internal combustion engine component is a cylinder block.

A transportation apparatus according to another preferred embodiment of the present invention includes an internal combustion engine having the aforementioned construction.

A method for producing an internal combustion engine component is a method for producing an internal combustion engine component having a slide surface, including: a step of providing a molding which is composed of an aluminum alloy containing silicon and which includes primary-crystal silicon grains and eutectic silicon grains near a surface; a step of polishing the surface of the molding by using a hone having a grit number of # 1500 or more; and a step of etching the polished surface of the molding to form a slide surface from which the primary-crystal silicon grains and eutectic silicon grains protrude.

In an internal combustion engine component according to a preferred embodiment of the present invention, the slide surface preferably has a ten point-average roughness $Rz_{JIS}$ of about 0.54 μm or more and a load length ratio Rmr(30) at a cut level of about 30% of the slide surface is about 20% or more. As a result, an improved lubricant retaining ability and an excellent abrasion resistance and burn-up resistance can be obtained.

Typically, the plurality of silicon crystal grains include a plurality of primary-crystal silicon grains and a plurality of eutectic silicon grains. Since not only primary-crystal silicon grains but also eutectic silicon grains remain jutting on the slide surface, the ten point-average roughness $Rz_{JIS}$ and the load length ratio Rmr(30) can easily fit within the aforementioned numerical ranges.

From the standpoint of improving the abrasion resistance and strength of the internal combustion engine component, it is preferable that the plurality of primary-crystal silicon grains have an average crystal grain size of no less than about 12 μm and no more than about 50 μm and that the plurality of eutectic silicon grains have an average crystal grain size of about 7.5 μm or less. It is also preferable that the plurality of silicon crystal grains have a grain size distribution having a first peak existing in a crystal grain size range of no less than about 1 μm and no more than about 7.5 μm and a second peak existing in a crystal grain size range of no less than about 12 μm and no more than about 50 μm. It is further preferable that the frequency at the first peak be at least about five times greater than the frequency at the second peak.

In order to sufficiently enhance the abrasion resistance and strength of the internal combustion engine component, it is preferable that the aluminum alloy contain: no less than about 73.4 mass % and no more than about 79.6 mass % of aluminum; no less than about 18 mass % and no more than about 22 mass % of silicon; and no less than about 2.0 mass % and no more than about 3.0 mass % of copper.

Moreover, it is preferable that the aluminum alloy contain no less than about 50 mass ppm and no more than about 200 mass ppm of phosphorus and no more than about 0.01 mass % of calcium. When the aluminum alloy contains no less than about 50 mass ppm and no more than about 200 mass ppm of phosphorus, the tendency of the silicon crystal grains to become gigantic can be suppressed, whereby the silicon crystal grains can be uniformly dispersed within the alloy. By ensuring that the calcium content in the aluminum alloy is no more than about 0.01 mass %, the effect of providing fine silicon crystal grains due to phosphorus is secured, and a metallurgical structure with excellent abrasion resistance can be obtained.

Various preferred embodiments of the present invention are broadly applicable to a variety of internal combustion engine components having slide surfaces, and can be suitably used for a cylinder block, a piston, a cylinder sleeve, a cam piece, and the like.

The internal combustion engine component according to various preferred embodiments of the present invention can be suitably used in internal combustion engines for various types of transportation apparatuses.

According to the method for producing the internal combustion engine component according to a preferred embodiment of the present invention, the surface of a molding having primary-crystal silicon grains and eutectic silicon grains near the surface is polished by using a hone having a grit number of # 1500 or more, and thereafter etched to form a slide surface. Therefore, a slide surface is obtained on which not only primary-crystal silicon grains but also eutectic silicon grains remain jutting. As a result, oil puddles of sufficient depth can be formed with a fine pitch, and thus an internal combustion engine component having excellent abrasion resistance and burn-up resistance can be produced.

According to preferred embodiments of the present invention, there is provided an internal combustion engine component having a slide surface with an excellent lubricant retaining ability, as well as a method for producing the same.

Other features, elements, processes, steps, characteristics and advantages of the present invention will become more apparent from the following detailed description of preferred embodiments of the present invention with reference to the attached drawings.

DETAILED DESCRIPTION OF PREFERRED EMBODIMENTS

Hereinafter, preferred embodiments of the present invention will be described with reference to the accompanying drawings. Although the following descriptions will be mainly directed to cylinder blocks as an example, the present invention is not limited thereto. The present invention is widely applicable to internal combustion engine components having a slide surface.

Figure 1:
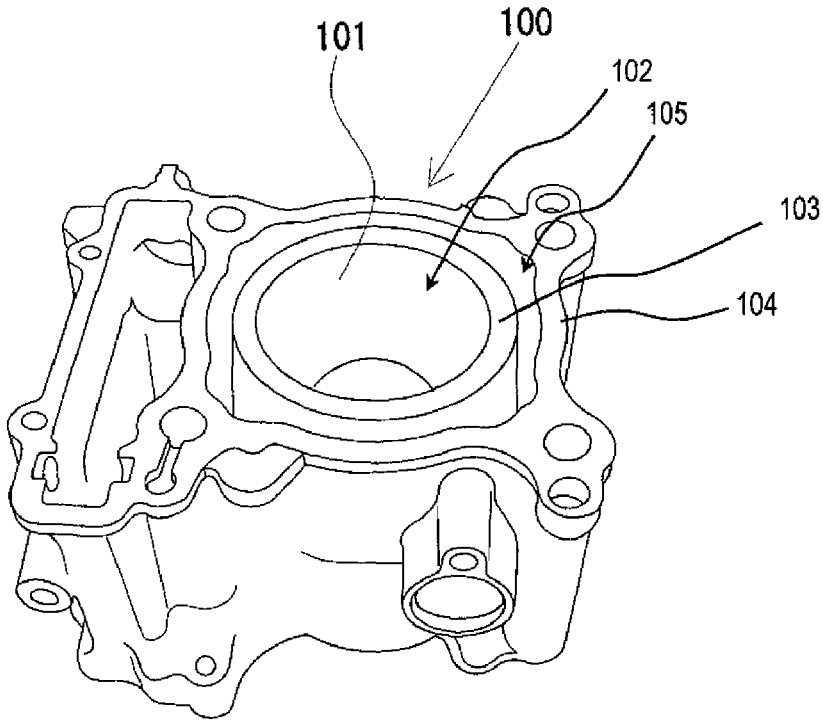
FIG. 1 is a perspective view schematically showing a cylinder block according to a preferred embodiment of the present invention.

FIG. 1 shows a cylinder block 100 according to the present preferred embodiment. The cylinder block 100 is formed of an aluminum alloy which contains silicon, and more specifically, an aluminum-silicon alloy of a hypereutectic composition containing a large amount of silicon.

As shown in FIG. 1, the cylinder block 100 preferably includes: a wall portion (referred to as a "cylinder bore wall") 103 defining a cylinder bore 102; and a wall portion (referred to as a "cylinder block outer wall") 104 surrounding the cylinder bore wall 103 and defining the outer contour of the cylinder block 100. Between the cylinder bore wall 103 and the cylinder block outer wall 104, a water jacket 105 for retaining a coolant is provided.

Figure 2:
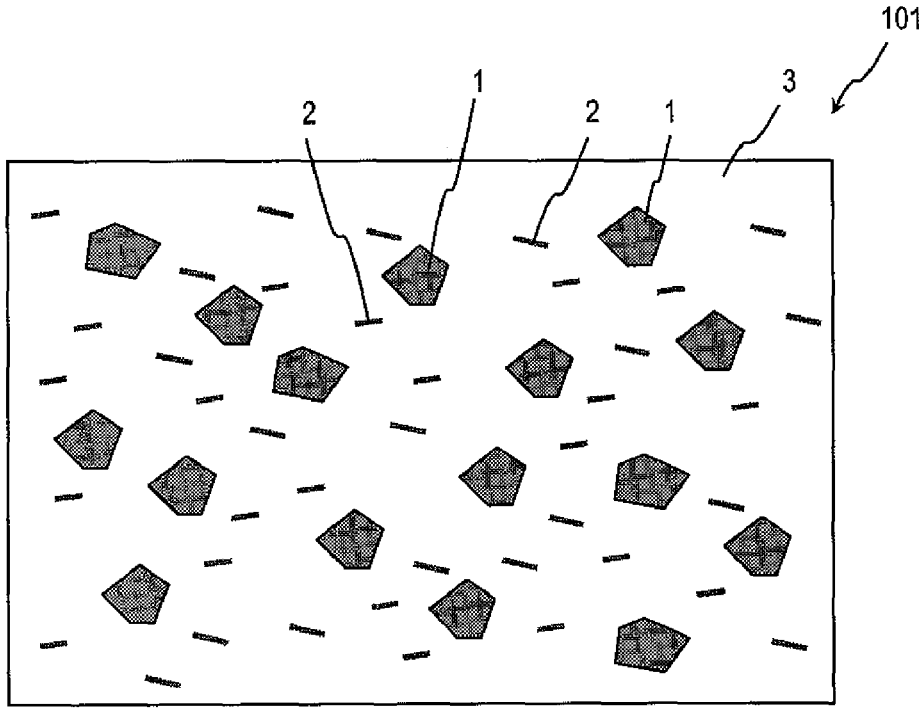
FIG. 2 is a plan view schematically showing an enlarged image of a slide surface of the cylinder block of FIG. 1.

The surface 101 of the cylinder bore wall 103 facing the cylinder bore 102 defines a slide surface which comes into contact with a piston. The slide surface 101 is shown enlarged in FIG. 2. FIG. 2 is a plan view schematically showing the slide surface 101.

As shown in FIG. 2, the cylinder block 100 includes a plurality of silicon crystal grains 1 and 2 on the slide surface 101. These silicon crystal grains 1 and 2 are present, in a dispersed manner, in a matrix (alloy base metal) 3 of solid solution which contains aluminum.

The silicon crystal grains which are the first to be formed when a melt of an aluminum-silicon alloy which has a hypereutectic composition are referred to as "primary-crystal silicon grains". The silicon crystal grains which are then formed are referred to as "eutectic silicon grains". Among the silicon crystal grains 1 and 2 shown in FIG. 2, the relatively large silicon crystal grains 1 are the primary-crystal silicon grains. The relatively small silicon crystal grains 2 present between the primary-crystal silicon grains are the eutectic silicon grains.

Figure 3:
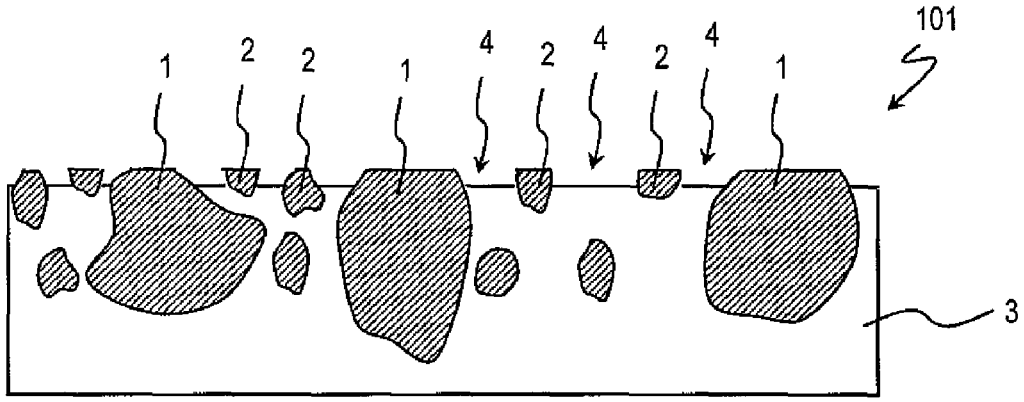
FIG. 3 is a cross-sectional view schematically showing an enlarged image of a slide surface of the cylinder block of FIG. 1.

FIG. 3 shows a cross-sectional structure of the slide surface 101. As shown in FIG. 3, the plurality of silicon crystal grains 1 and 2, including the primary-crystal silicon grains 1 and eutectic silicon grains 2, protrude (i.e., remain jutting) from a matrix 3. Recesses 4 formed between the silicon crystal grains 1 and 2 function as oil puddles in which a lubricant will be retained.

As parameters representing the surface roughness of the slide surface 101, the inventors have paid attention to a ten point-average roughness RzJIS and a load length ratio Rmr, and discovered that setting these parameters to be within specific ranges can greatly improve the ability of the slide surface 101 to retain a lubricant.

Specifically, by prescribing the ten point-average roughness $Rz_{JIS}$ of the slide surface 101 to be about 0.54 μm or more and prescribing the load length ratio Rmr(30) of the slide surface 101 at a cut level of about 30% to be about 20% or more, the lubricant retaining ability of the slide surface 101 can be sufficiently enhanced. The definitions of these two parameters, ten point-average roughness RzJIS and load length ratio Rmr, will be set forth later with reference to FIG. 17 and FIG. 18.

The inventors have studied the reasons why the conventional emboss honing process or etching process cannot realize a sufficient lubricant retaining ability. Thus, it has been found that most of the eutectic silicon grains are actually removed from the slide surface according to these conventional techniques, such that hardly any contribution of eutectic silicon grains to lubricant retention is obtained, thus resulting in a low lubricant retaining ability. The fact that eutectic silicon grains are removed from the slide surface also makes it difficult to keep the surface roughness of the slide surface within the aforementioned numerical range.

On the other hand, in the cylinder block 100 according to the present preferred embodiment, the eutectic silicon grains 2 on the slide surface 101 are allowed to sufficiently contribute to lubricant retention, thus ensuring that the ten point-average roughness RzJIS of the slide surface 101 is about 0.54 μm or more and that the load length ratio Rmr(30) at a cut level of about 30% is about 20% or more. As a result, the lubricant retaining ability of the slide surface 101 is greatly improved.

Figure 4:
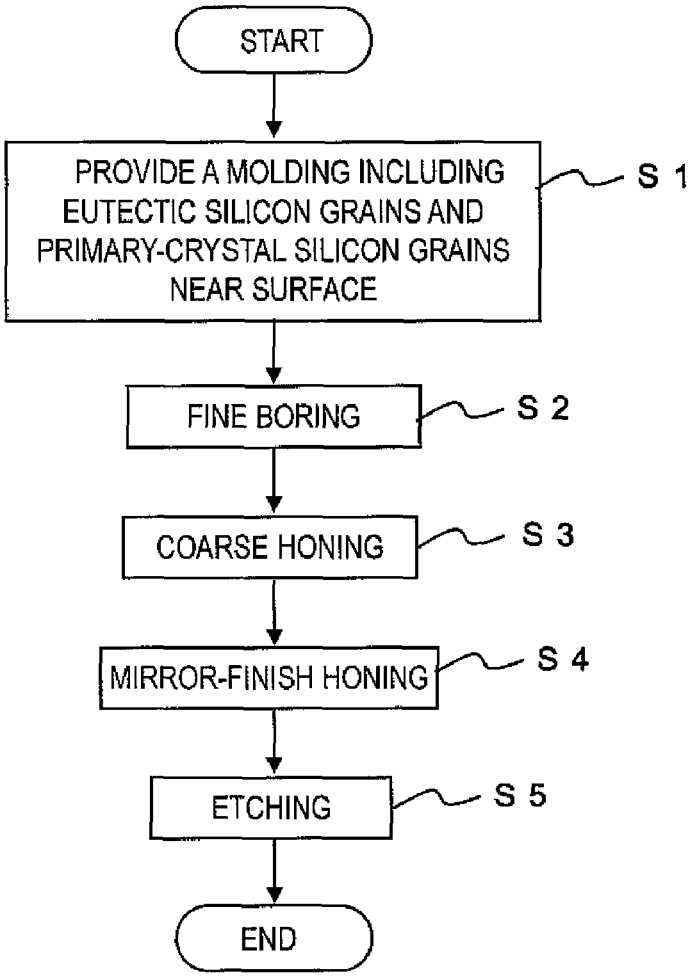
FIG. 4 is a flowchart showing production steps for the cylinder block of FIG. 1.
Figure 5:
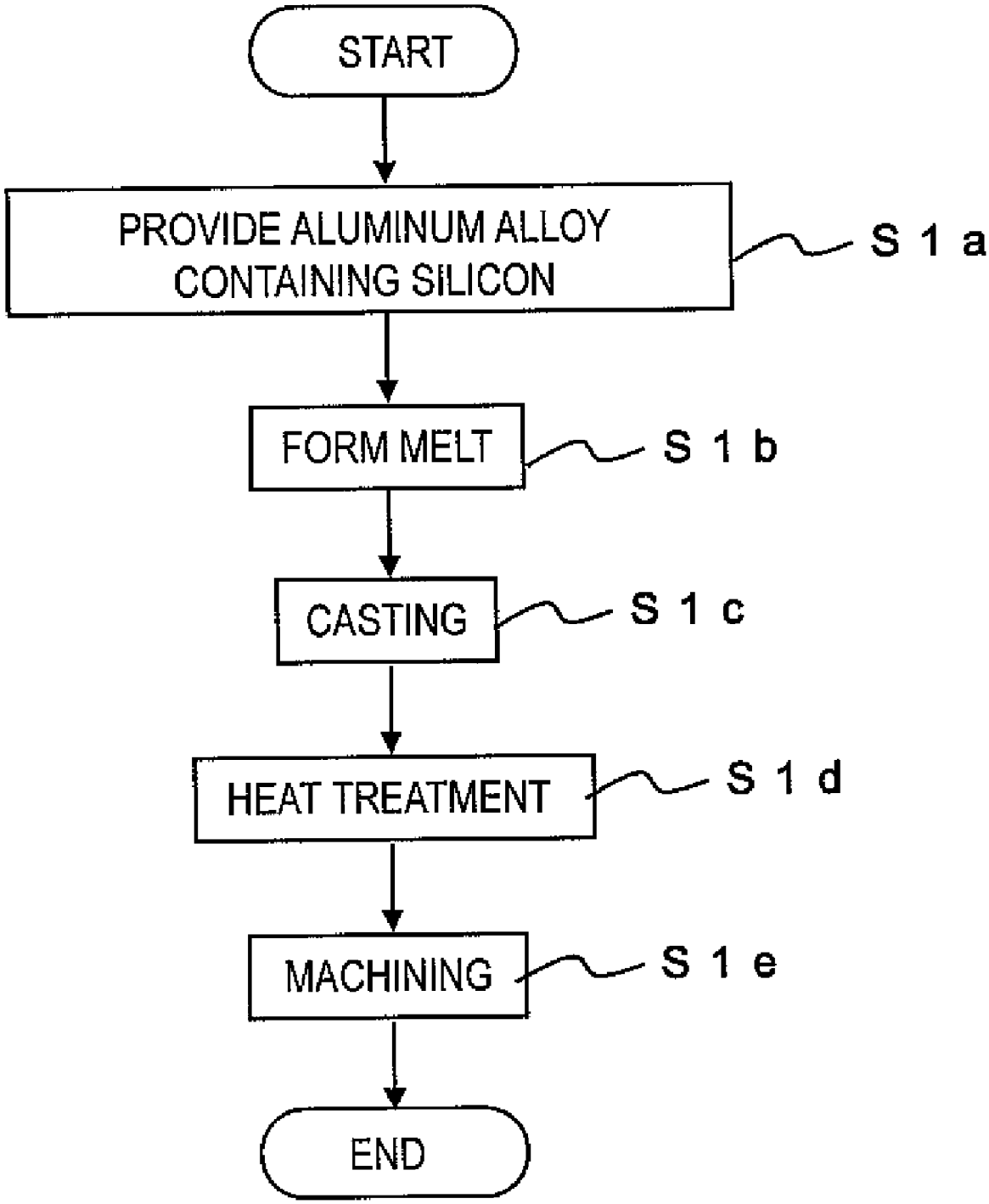
FIG. 5 is a flowchart showing production steps for the cylinder block of FIG. 1.

A method for producing the cylinder block 100 of the present preferred embodiment will be described with reference to FIG. 4, FIG. 5, and FIGS. 6A to 6D. FIG. 4 and FIG. 5 are flowcharts showing production steps for the cylinder block 100. FIGS. 6A to 6D are step-by-step cross-sectional views schematically showing, partly, the production steps.

First, a molding which is formed of an aluminum alloy containing silicon and which includes primary-crystal silicon grains and eutectic silicon grains near the surface is provided (step S1). The step S1 of providing the molding may include, for example, steps S1*a* to S1*e* shown in FIG. 5.

First, a silicon-containing aluminum alloy is prepared (step S1*a*). In order to ensure a sufficient abrasion resistance and strength of the cylinder block 100, it is preferable to use an aluminum alloy which contains: no less than about 73.4 mass % and no more than about 79.6 mass % of aluminum; no less than about 18 mass % and no more than about 22 mass % of silicon; and no less than about 2.0 mass % and no more than about 3.0 mass % of copper.

Next, the prepared aluminum alloy is heated and melted in a melting furnace, whereby a melt is formed (step S1*b*). It is preferable that about 100 mass ppm of phosphorus be added to the aluminum alloy before melting or to the melt. If the aluminum alloy contains no less than about 50 mass ppm and no more than about 200 mass ppm of phosphorus, it becomes possible to reduce the tendency of the silicon crystal grains to become gigantic, thus allowing for uniform dispersion of the silicon crystal grains within the alloy. On the other hand, if the calcium content in the aluminum alloy is about 0.01 mass % or less, the effect of providing fine silicon crystal grains due to phosphorus is secured, and a metallurgical structure with excellent abrasion resistance can be obtained. In other words, the aluminum alloy preferably contains no less than about 50 mass ppm and no more than about 200 mass ppm of phosphorus, and no more than about 0.01 mass % of calcium.

Next, casting is performed by using the aluminum alloy melt (step S1*c*). In other words, the melt is cooled within a mold to form a molding. At this time, the neighborhood of the slide surface is cooled at a large cooling rate (e.g., no less than about 4° C./sec and no more than about 50° C./sec), thus integrally forming a cylinder block in which silicon crystal grains contributing to abrasion resistance remain jutting. This casting step S1*c* can be performed by using, for example, a casting apparatus which is disclosed in International Publication No. 2004/002658.

Next, the cylinder block 100 which has been taken out of the mold is subjected to one of the heat treatments commonly known as "T5", "T6", and "T7" (step S1*d*). A T5 treatment is a treatment in which the molding is rapidly cooled (with water or the like) immediately after being taken out of the mold, and thereafter subjected to artificial aging at a predetermined temperature for a predetermined period of time to obtain improved mechanical properties and dimensional stability, followed by air cooling. A T6 treatment is a treatment in which the molding is subjected to a solution treatment at a predetermined temperature for a predetermined period after being taken out of the mold, then cooled with water, and thereafter subjected to artificial aging at a predetermined temperature for a predetermined period of time, followed by air cooling. A T7 treatment is a treatment for causing a stronger degree of aging than in the T6 treatment; although the T7 treatment can ensure better dimensional stability than does the T6 treatment, the resultant hardness will be lower than that obtained from the T6 treatment.

Next, predetermined machining is performed for the cylinder block 100 (step S1*e*). Specifically, a surface abutting with a cylinder head and a surface abutting with a crankcase are subjected to grinding or the like.

After the molding is prepared as described above, as shown in FIG. 6A, the surface of the molding, specifically, the inner surface of the cylinder bore wall 103 (i.e., the surface to become the slide surface 101) is subjected to a fine boring process (step S2).

Figure 6A:
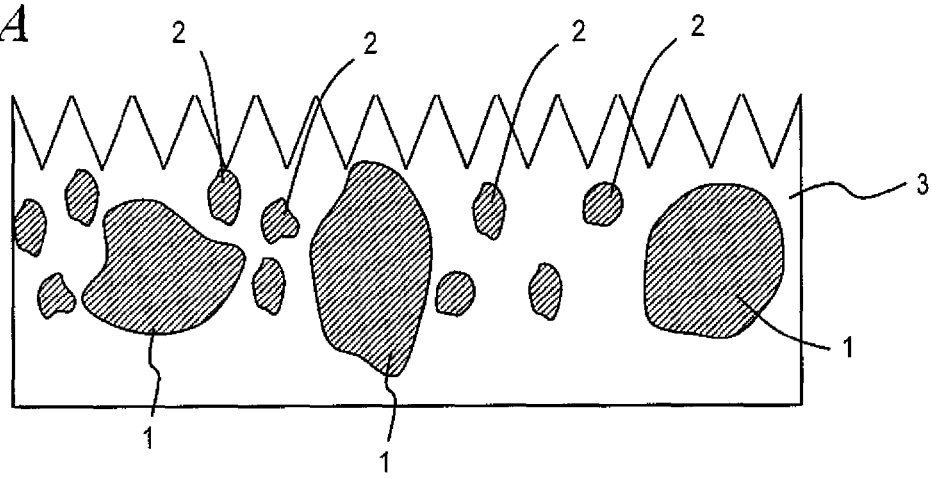
FIGS. 6A to 6D are step-by-step cross-sectional views schematically showing, partly, the production steps for the cylinder block of FIG. 1.
Figure 6B:
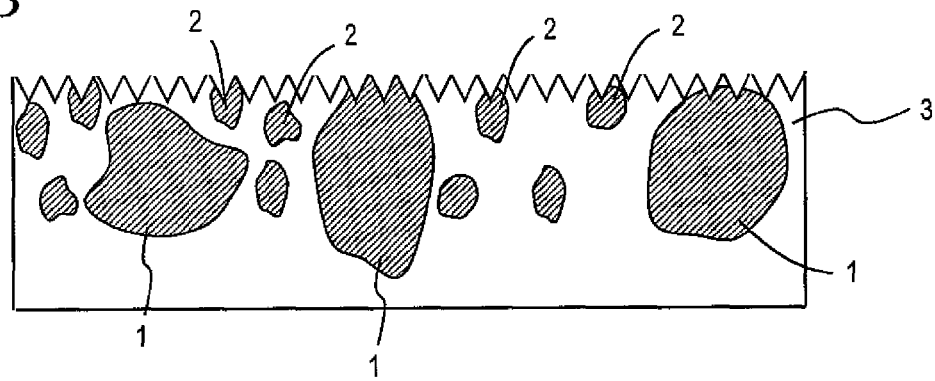

Next, as shown in FIG. 6B, the surface which has undergone a fine boring process is subjected to a coarse honing process (step S3). In other words, the surface to become the slide surface 101 is polished by using a hone having a relatively small grit number (specifically, with a grit number of # 800 or more). This coarse honing process can be performed by using a honing apparatus disclosed in Japanese Laid-Open Patent Publication No. 2004-268179, for example.

Figure 6C:
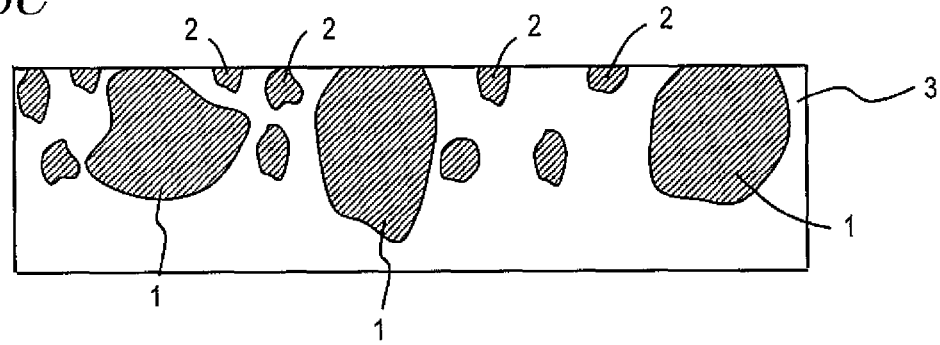

Next, as shown in FIG. 6C, a mirror-finish honing process is performed (step S4). In other words, the surface of the molding (the surface to become the slide surface 101) is polished by using a hone having a relatively large grit number (specifically, with a grit number of # 1500 or more). This mirror-finish honing process can also be performed by using a honing apparatus such as that disclosed in Japanese Laid-Open Patent Publication No. 2004-268179.

Figure 6D:
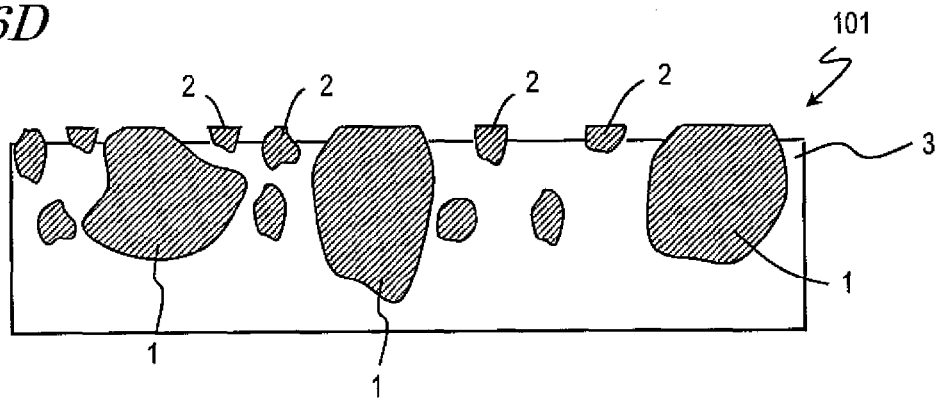

Thereafter, as shown in FIG. 6D, the polished surface of the molding is subjected to an etching (e.g., an alkaline etching), thereby forming the slide surface 101 from which the primary-crystal silicon grains 1 and the eutectic silicon grains 2 protrude (step S5). Through this etching process, the matrix 3 near the surface is removed to a predetermined thickness, thus allowing oil puddles 4 to be formed between the primary-crystal silicon grains 1 and the eutectic silicon grains 2. The depth of the oil puddles 4 can be adjusted as appropriate based on the concentration and temperature of the etchant, etching time (immersion time), and the like.

Note that the sizing steps to be performed before the mirror-finish honing process (step S4) are not limited to the two steps exemplified above, i.e., a fine boring process (step S2) and a coarse honing process (step S3). Sizing may be performed through a single step, or sizing may be performed through three or more steps.

As described above, in the present preferred embodiment, the slide surface 101 is formed by performing an etching after a polish using a hone having a grit number of # 1500 or more. In other words, a surface smoothing process (through a mirror-finish honing process) is first performed, and then a chemical grinding (through etching) is performed, whereby the oil puddles 4 are formed. By forming the slide surface 101 in this manner, the eutectic silicon grains 2 are allowed to remain on the slide surface 101 without dropping off, so that the eutectic silicon grains 2 can sufficiently contribute to lubricant retention. Hereinafter, the reasons behind this will be described in more detail, in comparison with the conventional emboss honing process or etching process.

Figure 7A:
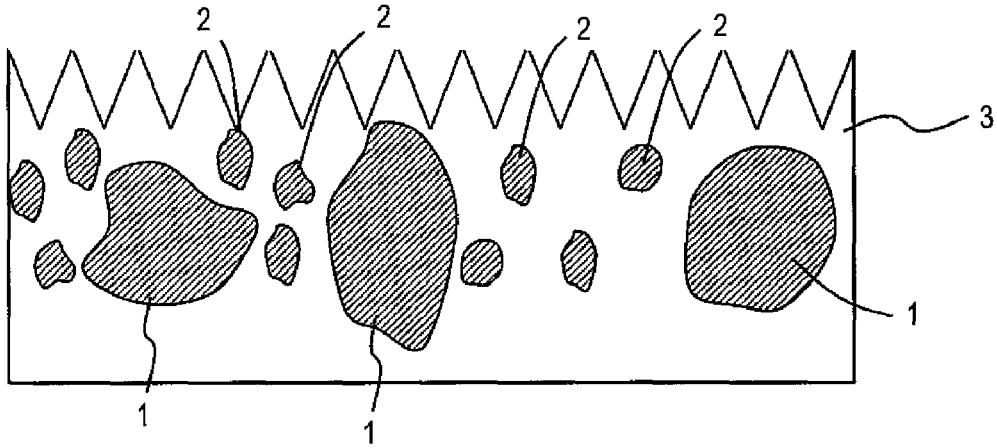
FIGS. 7A to 7C are diagrams for explaining a reason why eutectic silicon grains do not contribute to lubricant retention when an emboss honing process is performed.
Figure 7B:
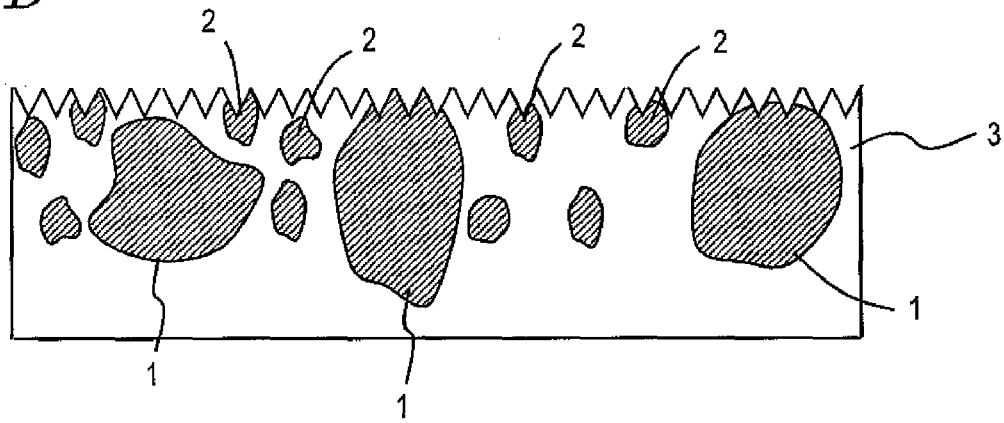
Figure 7C:
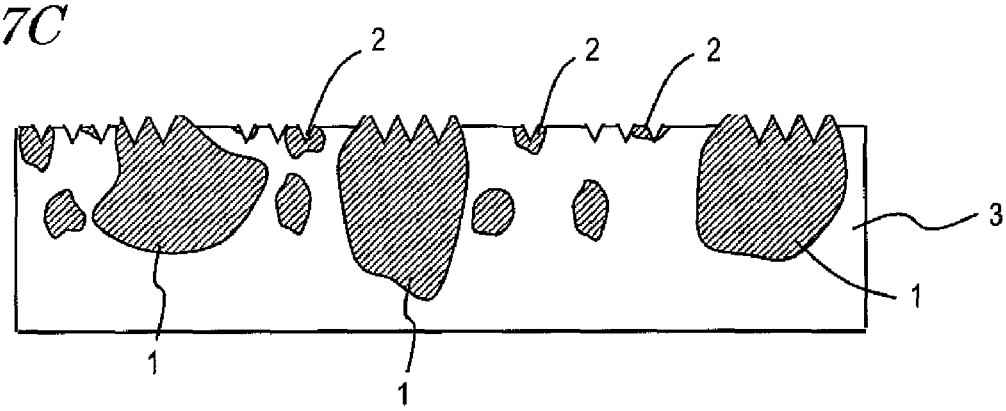

In the case where an emboss honing process is employed to form the slide surface 101, a molding having primary-crystal silicon grains and eutectic silicon grains near its surface is prepared first (same step as the step S1 shown in FIG. 4), and then the surface of the molding is subjected to a fine boring process, as shown in FIG. 7A. Then, after performing a coarse honing process as shown in FIG. 7B, an emboss honing process is performed as shown in FIG. 7C. The emboss honing process is performed by using a resin brush on which abrasive grains are adhered, and is performed in such a manner that mainly the matrix 3 will be cut. However, the emboss honing process, which is a mechanical grinding process, will inevitably remove a portion of the eutectic silicon grains 2 together with the matrix 3, as schematically shown in FIG. 7C. Therefore, the eutectic silicon grains 2 do not contribute much to lubricant retention.

Figure 8A:
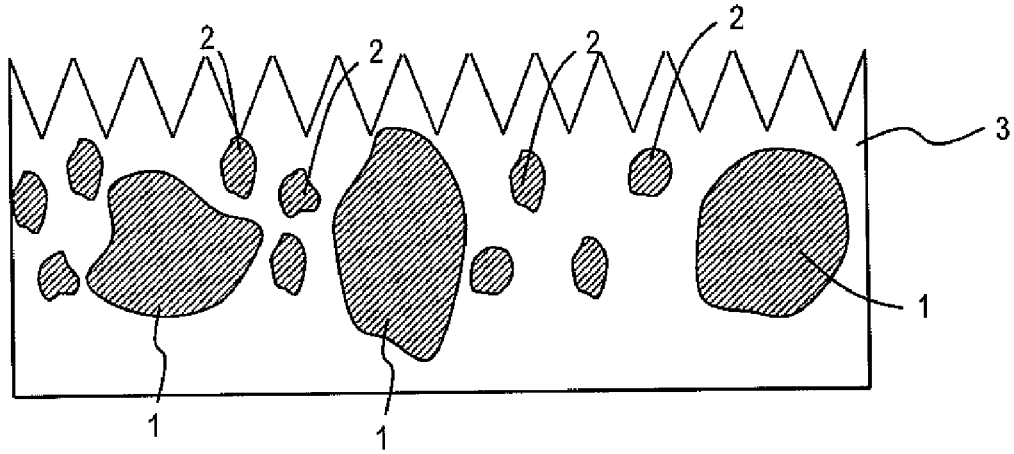
FIGS. 8A to 8C are diagrams for explaining a reason why eutectic silicon grains do not contribute to lubricant retention when an etching process is performed without first performing a mirror-finish honing process.
Figure 8B:
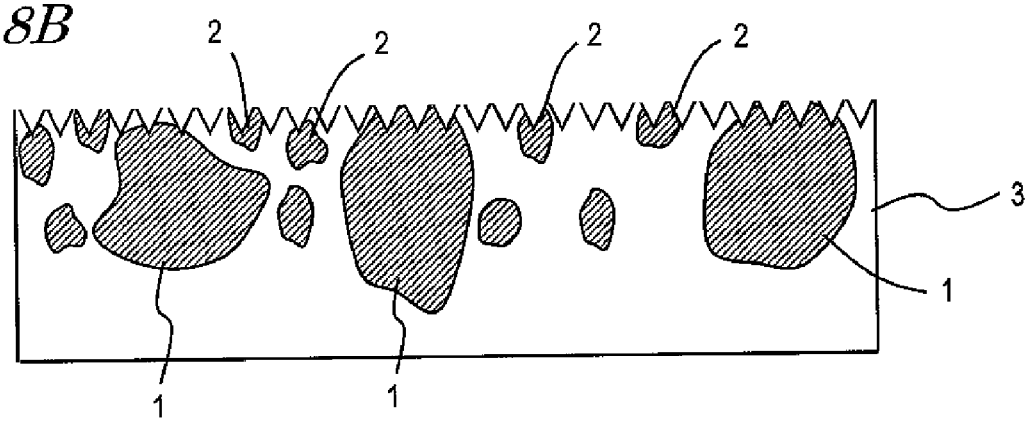
Figure 8C:
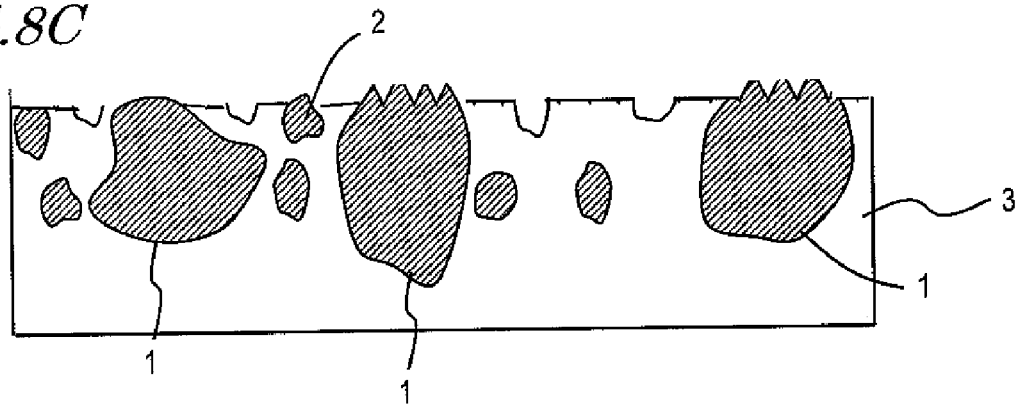

On the other hand, in the case where the slide surface 101 is formed through an etching process which is not preceded by a mirror-finish honing process, a molding having primary-crystal silicon grains and eutectic silicon grains near its surface is prepared first (same step as the step S1 shown in FIG. 4), and then the surface of the molding is subjected to a fine boring process as shown in FIG. 8A. Next, a coarse honing process is performed as shown in FIG. 8B, and thereafter an etching process is performed as shown in FIG. 8C. In this case, those eutectic silicon grains 2 whose surfaces have been damaged (i.e., cracked or broken) through the coarse honing process will remain jutting. Such eutectic silicon grains 2 will eventually drop off the slide surface 101 as schematically shown in FIG. 8C. Therefore, the eutectic silicon grains 2 do not contribute much to lubricant retention.

In the present preferred embodiment, a mirror-finish honing process is performed before an etching process, in which case the etching process (which is a chemical grinding process) does not remove the eutectic silicon grains 2 together with the matrix 3, unlike in the emboss honing process (which is a mechanical grinding). Moreover, since the surface is smoothed through a mirror-finish honing process (which also encompasses the surface of the eutectic silicon grains 2) before the etching process, drop-off of the eutectic silicon grains 2 occurs less frequently than in the case where the etching process is performed immediately after a coarse honing process. Therefore, the eutectic silicon grains 2 sufficiently contribute to lubricant retention.

Next, results of actually prototyping the cylinder block 100 according to the present preferred embodiment and subjecting them to an abrasion resistance evaluation test will be described.

Using an aluminum alloy of the composition shown in Table 1 below, a cylinder block 100 was produced by a high-pressure die-casting technique like that disclosed in the pamphlet of International Publication No. 2004/002658.

TABLE 1

| Si | Cu | Mg |
|---|---|---|
| 22.0 mass % | 2.5 mass % | 0.50 mass % |
| Fe | P | Al |
| 0.3 mass % | 0.01 mass % | balance |

The honing processes (coarse honing process and mirror-finish honing process) were performed by using a honing apparatus as disclosed in Japanese Laid-Open Patent Publication No. 2004-268179, while supplying cooling oil onto the surface to be polished (i.e., wet honing). A hone with a grit number of # 600 was used for the coarse honing process, whereas a hone with a grit number of # 1500 or # 2000 was used for the mirror-finish honing process. Note that a higher grit number indicates that the hone has finer abrasive grains and therefore the polished surface will attain a higher smoothness. However, as the abrasive grains become finer, the speed of cutting will decrease, thus resulting in a longer processing time and lower producibility. In other words, the production method according to the present preferred embodiment dares to perform the mirror-finish honing process which is disadvantageous in terms of producibility.

The etching process was performed by using an approximately 5 mass % sodium hydroxide solution, under conditions such that the temperature of the solution was about 70° C. The etching amount (etching depth) was adjusted by varying the immersion time.

An internal combustion engine was assembled by using the cylinder block 100 as well as an aluminum-alloy piston which was separately produced by forging. Immediately after a state where the internal combustion engine was still cold and the lubricant had not permeated the cylinder, this internal combustion engine was operated for 5 minutes at a revolution speed of 8000 rpm, and scratches occurring on the slide surface 101 (i.e., scuffing) were observed through visual inspection to determine whether the cylinder block would qualify for use. The results are shown in Table 2 below. Table 2 also shows a ten point-average roughness RzJIS and a load length ratio Rmr(30) at a cut level of about 30% of the slide surface 101, as measured by using SURFCOM 1400D manufactured by TOKYO SEIMITSU CO., LTD. As will be described in more detail later, the ten point-average roughness RzJIS is a parameter that can be used for evaluating the depth of the oil puddles 4, whereas the load length ratio Rmr(30) is a parameter that can be used for evaluating the number of eutectic silicon grains 2 that remain jutting (i.e., remaining without dropping off) on the slide surface 101.

TABLE 2

| | step | Rmr (30) [%] | $Rz_{JIS}$ [μm] | evaluation results |
|---|---|---|---|---|
| Example 1 | #600⇒ #2000⇒ alkaline etching | 40 | 0.54 | OK |
| Example 2 | #600⇒ #2000⇒ alkaline etching | 45 | 1.32 | OK |
| Example 3 | #600⇒ #2000⇒ alkaline etching | 30 | 0.82 | OK |
| Example 4 | #600⇒ #2000⇒ alkaline etching | 50 | 1.10 | OK |
| Example 5 | #600⇒ #2000⇒ alkaline etching | 20 | 2.76 | OK |
| Example 6 | #600⇒ #1500⇒ alkaline etching | 75 | 1.15 | OK |
| Example 7 | #600⇒ #1500⇒ alkaline etching | 30 | 1.97 | OK |
| Example 8 | #600⇒ #1500⇒ alkaline etching | 60 | 0.65 | OK |
| Example 9 | #600⇒ #1500⇒ alkaline etching | 35 | 1.62 | OK |
| Example 10 | #600⇒ #1500⇒ alkaline etching | 50 | 0.75 | OK |
| Comparative Example 1 | #600⇒ #2000 | 8 | 0.28 | NG |
| Comparative Example 2 | #600⇒ emboss honing | 5 | 0.37 | NG |
| Comparative Example 3 | #600⇒ #2000⇒ emboss honing | 15 | 0.43 | NG |
| Comparative Example 4 | #600⇒ #2000⇒ emboss honing | 12 | 0.45 | NG |
| Comparative Example 5 | #600⇒ #2000⇒ emboss honing | 5 | 0.43 | NG |
| Comparative Example 6 | #600⇒ #2000⇒ emboss honing | 3 | 0.76 | NG |
| Comparative Example 7 | #600⇒ #2000⇒ alkaline etching | 50 | 0.40 | NG |
| Comparative Example 8 | #600⇒ #2000⇒ alkaline etching | 15 | 4.05 | NG |

TABLE 2-continued

| | step | Rmr (30) [%] | $Rz_{JIS}$ [μm] | evaluation results |
|---|---|---|---|---|
| Comparative Example 9 | #600 ⇒ alkaline etching | 15 | 1.20 | NG |

As can be seen from Table 2, in Examples 1 to 10, where the etching process was performed after a mirror-finish honing process, the ten point-average roughness $Rz_{JIS}$ was about 0.54 μm or more and the load length ratio Rmr(30) was about 20% or more, and thus scuffing did not occur. Note that the reason why the values of the ten point-average roughness $Rz_{JIS}$ and load length ratio Rmr(30) vary among Examples 1 to 5, although hones with the same grit number (# 2000) were used in the mirror-finish honing process, is that the etching time is different. For the same reason, the values of the ten point-average roughness $Rz_{JIS}$ and load length ratio Rmr(30) vary among Examples 6 to 10 although hones with the same grit number (# 1500) were used in the mirror-finish honing process. The etching times (sec) in Examples 1 to were as shown in Table 3 below.

TABLE 3

| Example | etching time (sec) |
|---|---|
| 1 | 10 |
| 2 | 25 |
| 3 | 15 |
| 4 | 20 |
| 5 | 40 |
| 6 | 20 |
| 7 | 35 |
| 8 | 10 |
| 9 | 30 |
| 10 | 10 |

On the other hand, in Comparative Example 1 (where neither an etching process nor an emboss honing process was performed after a coarse honing process and a mirror-finish honing process) and Comparative Example 2 (where an emboss honing process was performed after a coarse honing process), the ten point-average roughness $Rz_{JIS}$ was less than 0.54 μm, and the load length ratio Rmr(30) was less than 20%, indicative of scuffing.

Furthermore, in Comparative Examples 3 to 6 where an emboss honing process was performed after a coarse honing process and a mirror-finish honing process, the load length ratio Rmr(30) was less than 20%, and the ten point-average roughness $Rz_{JIS}$ was less than 0.54 μm (except for Comparative Example 6), indicative of scuffing.

In Comparative Example 7, the ten point-average roughness $Rz_{JIS}$ was less than 0.54 μm although an etching process was performed after a mirror-finish honing process. This is because the etching time was too short to provide a sufficient etching amount. In Comparative Example 8, the load length ratio Rmr(30) was less than 20% although an etching process was performed after a mirror-finish honing process. This is because the etching time was too long, thus resulting in an excessive etching amount. The etching times in Examples 1 to 10 were 10 to 40 seconds as shown in Table 3, whereas the etching time in Comparative Example 7 was 8 seconds, and the etching time in Comparative Example 8 was 70 seconds.

Also in Comparative Example 9, where an etching process was performed directly after a coarse honing process (i.e., without performing a mirror-finish honing process), the load length ratio Rmr(30) was less than 20%, indicative of scuffing.

Figure 9:
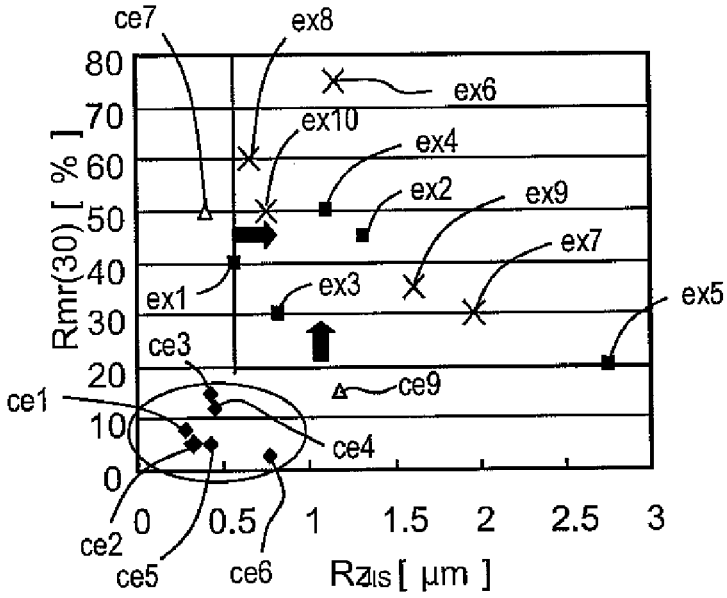
FIG. 9 is a graph in which Examples 1 to 10 and Comparative Examples 1 to 7 are plotted, on a horizontal axis representing a ten point-average roughness $Rz_{JIS}$ and a vertical axis representing a load length ratio Rmr(30) at a cut level of 30%.

FIG. 9 is a graph in which Examples 1 to 10 and Comparative Examples 1 to 7 and 9 are plotted on a horizontal axis representing the ten point-average roughness $Rz_{JIS}$ and a vertical axis representing the load length ratio Rmr(30).

As can be seen from FIG. 9, in Examples 1 to 10, where no scuffing occurred (shown as ex1 to ex10 in the graph), the ten point-average roughness $Rz_{JIS}$ was about 0.54 μm or more and the load length ratio Rmr(30) was about 20% or more. On the other hand, in Comparative Examples 1 to 7 and 9 which suffered scuffing (shown as ce1 to ce7 and ce9 in the graph), at least one of the ten point-average roughness $Rz_{JIS}$ and load length ratio Rmr(30) falls outside the aforementioned numerical range(s). Therefore, it can be seen that the lubricant retaining ability is improved and scuffing is prevented under the conditions that the ten point-average roughness $Rz_{JIS}$ is about 0.54 μm or more and the load length ratio Rmr(30) at a cut level of about 30% is about 20% or more. Note that, when the ten point-average roughness $Rz_{JIS}$ exceeds about 4.0 μm as shown in Comparative Example 8, significant drop-off of the fine eutectic silicon grains may occur so that the fine voids for retaining lubricant (oil puddles 4 with a fine pitch) may decrease. Therefore, preferably, the ten point-average roughness $Rz_{JIS}$ is about 4.0 μm or less.

Figure 10A:
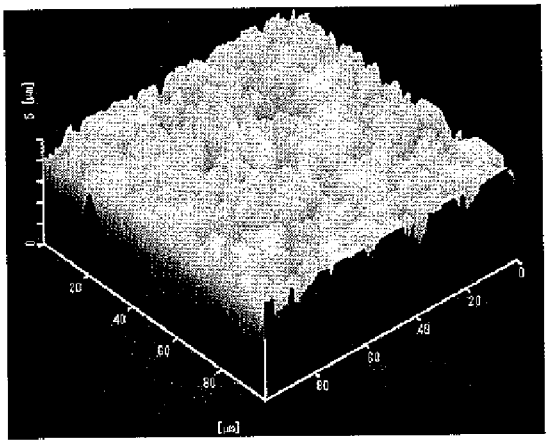
FIGS. 10A and 10B are atomic force microscope (AFM) photographs showing slide surfaces of cylinder blocks of Example 2 and Comparative Example 2, respectively.
Figure 10B:
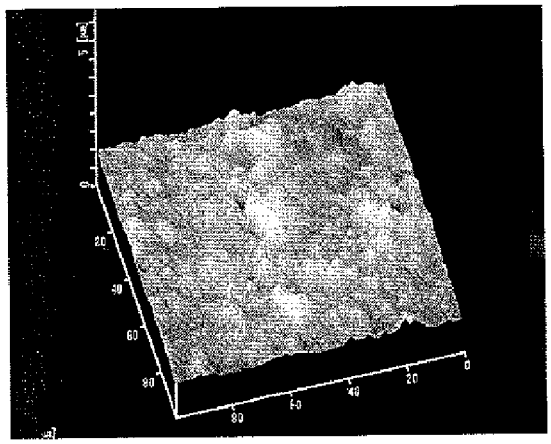

FIGS. 10A and 10B show atomic force microscope (AFM) photographs of slide surfaces of the cylinder blocks of Example 2 and Comparative Example 2. As shown in FIG. 10A, protrusions and depressions exist generally uniformly with a fine pitch on the slide surface of Example 2, such that not only primary-crystal silicon grains 1 but also a large number of eutectic silicon grains 2 remain jutting. On the other hand, as shown in FIG. 10B, only a few protrusions exist on the slide surface of Comparative Example 2, indicating that mostly the primary-crystal silicon grains 1 remain jutting.

Figure 11A:
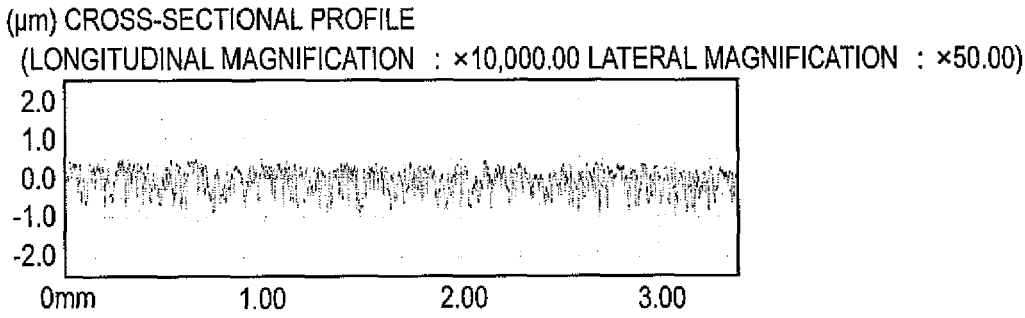
FIGS. 11A and 11B are graphs showing cross-sectional profiles of slide surfaces of Example 2 and Comparative Example 2.
Figure 11B:
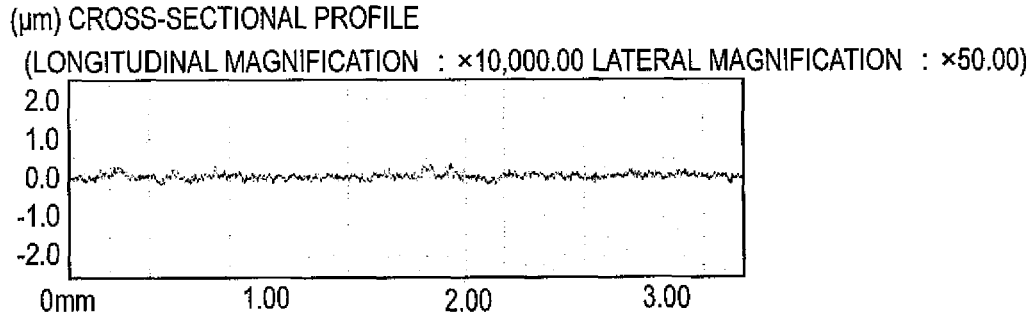

FIGS. 11A and 11B show cross-sectional profiles of the slide surfaces of Example 2 and Comparative Example 2. As shown in FIG. 11A, a large number of depressions of sufficient depth exist on the slide surface of Example 2 with a fine pitch, indicative of oil puddles 4 being created by the eutectic silicon grains 2. On the other hand, as shown in FIG. 11B, no depressions of sufficient depth exist on the slide surface of Comparative Example 2, indicating that the eutectic silicon grains 2 are not substantially creating oil puddles 4.

Figure 12A:
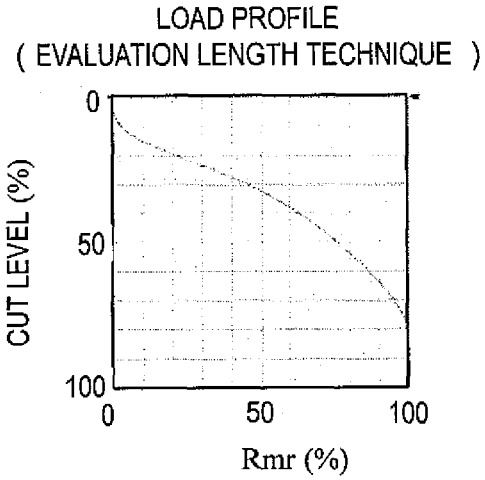
FIGS. 12A and 12B are graphs showing load profiles of slide surfaces of Example 2 and Comparative Example 2.
Figure 12B:
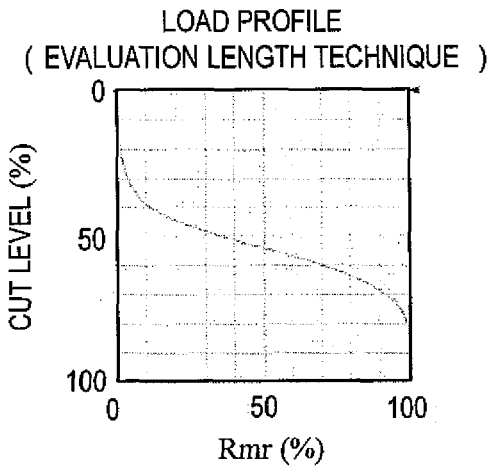

FIGS. 12A and 12B show load profiles of the slide surfaces of Example 2 and Comparative Example 2. As shown in FIG. 12A, the slide surface of Example 2 has a high load length ratio Rmr even at a relatively low cut level (e.g., around 30%), thus indicating that not only primary-crystal silicon grains 1 but also a large number of eutectic silicon grains 2 remain jutting. On the other hand, as shown in FIG. 12B, the slide surface of Comparative Example 2 has a low load length ratio Rmr at a relatively low cut level (e.g., around 30%), indicating that not many eutectic silicon grains 2 remain jutting.

Figure 13A:
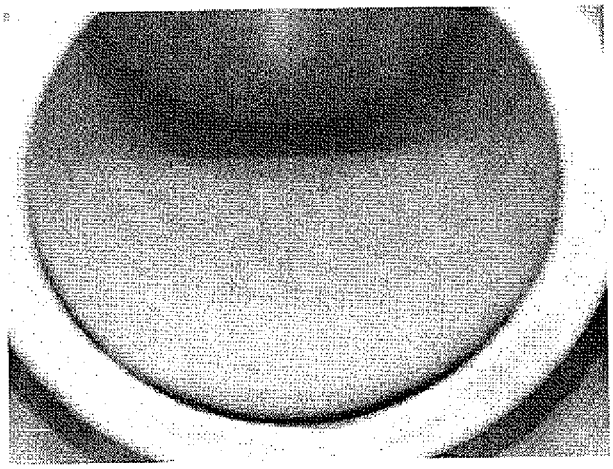
FIGS. 13A and 13B are photographs showing slide surfaces of the cylinder blocks of Example 2 and Comparative Example 2 after being subjected to an operation test.
Figure 13B:
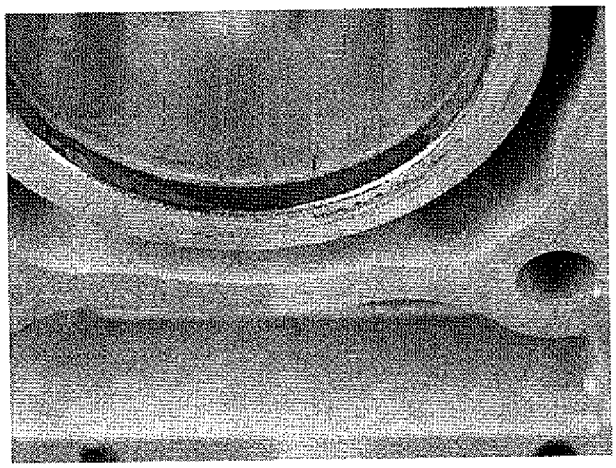

FIGS. 13A and 13B show photographs of the slide surfaces of the cylinder blocks of Example 2 and Comparative Example 2 after being subjected to an operation test. As shown in FIG. 13A, the slide surface of Example 2 hardly has any scratches, indicative of no scuffing. On the other hand, as shown in FIG. 13B, the slide surface of Comparative Example 2 has a large number of scratches, indicative of scuffing.

The reason why Example 2 is free of scuffing but Comparative Example 2 suffers scuffing, as also evidenced by FIGS. 13A and 13B, is that there is a difference in lubricant retaining ability between Example 2 and Comparative Example 2.

Figure 14A:
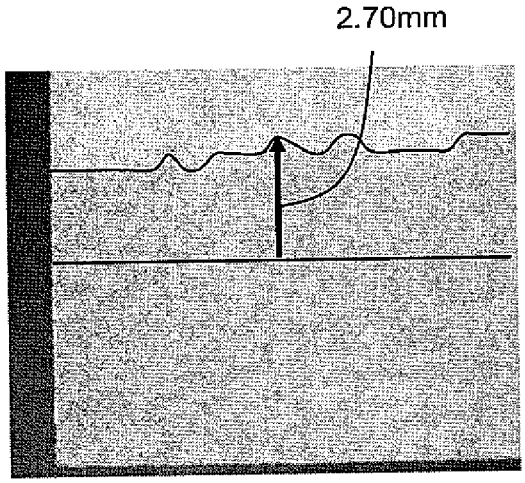
FIGS. 14A and 14B are photographs showing results of a wettability test performed for slide surfaces of the cylinder blocks of Example 2 and Comparative Example 2.
Figure 14B:
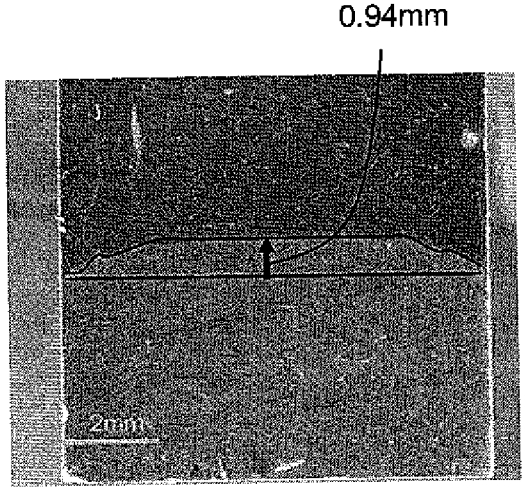

FIGS. 14A and 14B show results of performing a wettability test on the slide surfaces of cylinder blocks of Example 2 and Comparative Example 2. Whereas the slide surface of Example 2 absorbs lubricant to a high level as shown in FIG. 14A (where absorption up to 2.70 mm is occurring), the slide surface of Comparative Example 2 does not absorb lubricant to a high level as shown in FIG. 14(*b*) (where absorption is occurring only up to about 0.94 mm). Thus, it can be seen that the slide surface of Example 2 has a higher lubricant retaining ability than does the slide surface of Comparative Example 2.

Figure 15:
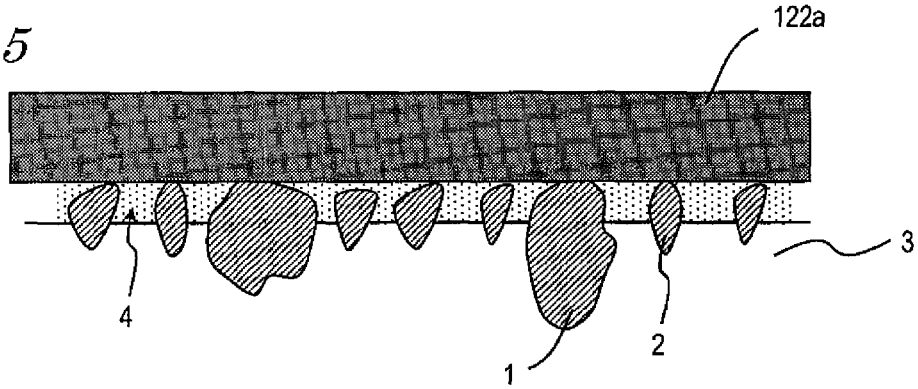
FIG. 15 is a cross-sectional view schematically showing slide surfaces on which not only primary-crystal silicon grains but also eutectic silicon grains remain jutting.

As has been described above, a high lubricant retaining ability is obtained when not only primary-crystal silicon grains 1 but also a large number of eutectic silicon grains 2 remain jutting on the slide surface 101. As schematically shown in FIG. 15, oil puddles 4 of sufficient depth are formed with a fine pitch when a large number of eutectic silicon grains 2 remain jutting, whereby the lubricant retaining ability is enhanced and the burn-up resistance is improved. Since a large number of eutectic silicon grains 2 remain jutting, the area of the portions which actually come in contact with a piston ring 122*a* is increased as compared to the case where only the primary-crystal silicon grains 1 remain jutting. As a result, the load per unit area that is applied during a slide is reduced, whereby an improved abrasion resistance is obtained.

Figure 16:
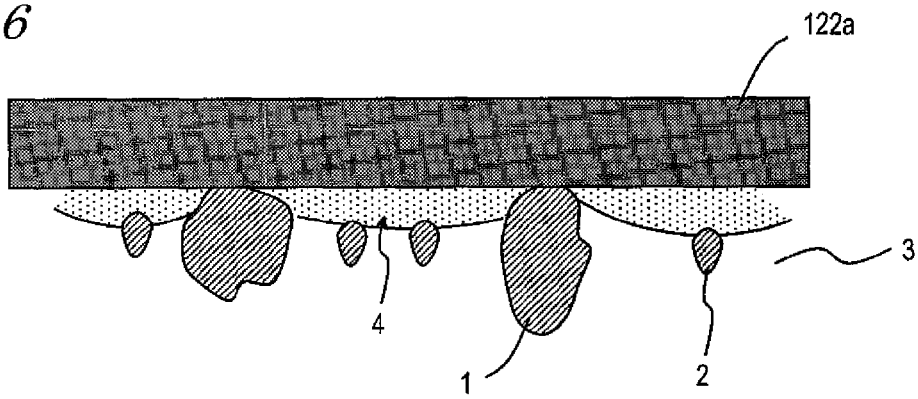
FIG. 16 is a cross-sectional view schematically showing a slide surface on which substantially nothing but primary-crystal silicon grains remain jutting.

On the other hand, as schematically shown in FIG. 16, when substantially nothing but the primary-crystal silicon grains 1 remain jutting, the oil puddles 4 are formed with a coarse pitch, resulting in a lower lubricant retaining ability and burn-up resistance. Since hardly any eutectic silicon grains 2 remain jutting, the area of the portions which actually come in contact with the piston ring 122*a* is small, thus resulting in a low abrasion resistance.

As parameters representing the surface roughness of the slide surface 101, the present preferred embodiment pays attention to the ten point-average roughness RzJIS and the load length ratio Rmr(30) at a cut level of about 30%.

Figure 17:
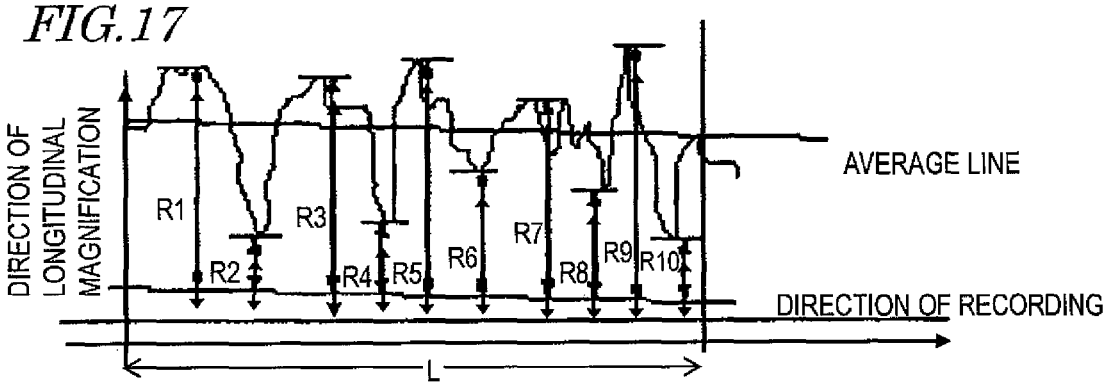
FIG. 17 is a diagram for explaining a ten point-average roughness $Rz_{JIS}$.

The ten point-average roughness RzJIS is, with respect to a portion taken from a cross-sectional profile, the portion extending a reference length L (as shown in FIG. 17), a difference between an average value of heights R1, R3, R5, R7, and R9 of the five highest apices and an average value of the heights R2, R4, R6, R8, and R10 of the five lowest troughs, as expressed by eq. 1 below.

$$Rz_{JIS} = \frac{(R1 + R3 + R5 + R7 + R9) - (R2 + R4 + R6 + R8 + R10)}{5} \quad \text{eq. 1}$$

Therefore, a large ten point-average roughness RzJIS means that the oil puddles 4 having a sufficient depth. As has already been described with respect to experimental results above, a ten point-average roughness RzJIS of about 0.54 μm is preferable in terms of lubricant retaining ability.

Figure 18:
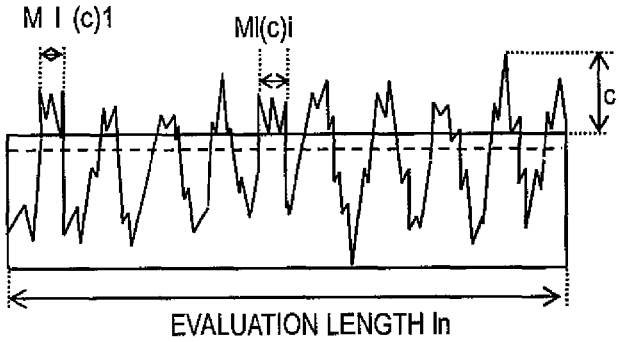
FIG. 18 is a diagram for explaining a load length ratio Rmr(c).

A load length ratio Rmr(c) at a given cut level c is, with respect to a portion taken from a roughness profile, the portion extending an evaluation length ln (as shown in FIG. 18), a ratio of the sum of cut lengths when the roughness profile is cut at a cut level c which is parallel to a line connecting the apices (i.e., load length) Ml(c) to the evaluation length ln, as expressed by eq. 2 below.

$$Rmr(c) = \frac{100}{\ln} \sum_{i=1}^{m} Ml(c)i \ (\%) \quad \text{eq. 2}$$

Therefore, the load length ratio Rmr(c) is an index indicating how many silicon grains 1 and 2 remain jutting on the slide surface 101. A large load length ratio Rmr(c) means that a large number of eutectic silicon grains 2 remain jutting. In an early stage of operation of an internal combustion engine, the outermost surface of the slide surface 101 is abraded approximately to a depth corresponding to a cut level of about 30%. Therefore, it can be said that a load length ratio Rmr(30) at a cut level of about 30% serves as a parameter indicating how many or few eutectic silicon grains 2 remain jutting during an actual operation. As has already been described with respect to experimental results above, it is preferable that the load length ratio Rmr(30) at a cut level of about 30% is about 20% or more in terms of lubricant retaining ability.

Figure 19:
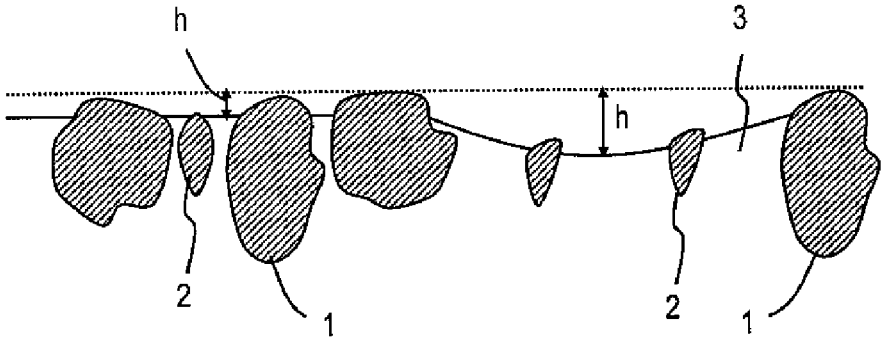
FIG. 19 is a diagram for explaining a reason why a constant emboss height cannot be obtained when an emboss honing process is employed.

As has already been described above, with the conventional emboss honing process, it is difficult to ensure that the ten point-average roughness RzJIS and load length ratio Rmr (30) are within the aforementioned numerical ranges. The reason thereof will be described with reference to FIG. 19.

In an emboss honing process which is a mechanical grinding process, the grinding amount differs between regions where the silicon crystal grains 1 and 2 are sparse and regions where they are dense. Specifically, as shown at the right-hand side in FIG. 19, deep grinding occurs in a region where the silicon crystal grains 1 and 2 are sparse, thus resulting in a large emboss height h. However, as shown in at the left-hand side in FIG. 19, only shallow grinding occurs in a region where the silicon crystal grains 1 and 2 are dense, thus resulting in a small emboss height h. Therefore, it is difficult to obtain a large ten point-average roughness RzJIS over the entire slide surface 101. Moreover, since the eutectic silicon grains 2 will be ground together with the matrix 3, it is also difficult to obtain a high load length ratio Rmr(30).

Figure 20:
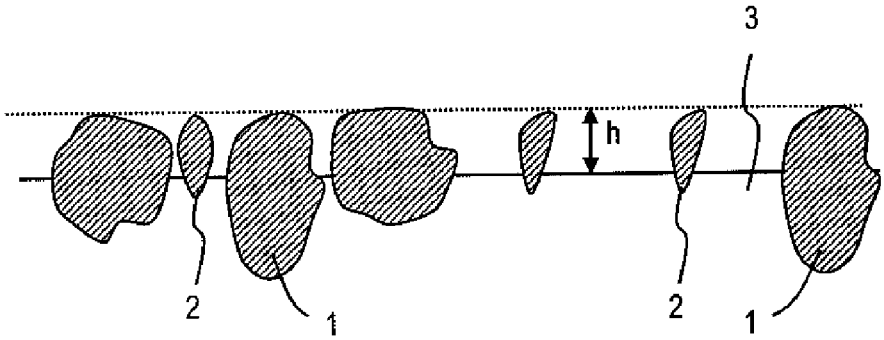
FIG. 20 is a diagram for explaining a reason why a constant emboss height is obtained when an etching process is employed.

On the other hand, in an etching process (which is a chemical grinding process), as shown in FIG. 20, grinding occurs down to a constant depth regardless of whether the silicon crystal grains 1 and 2 are sparse or dense, so that a constant emboss height h is obtained. Therefore, by adjusting the concentration and temperature of the etchant and the etching time, the ten point-average roughness RzJIS can be easily increased. Moreover, since the eutectic silicon grains 2 will not be ground together with the matrix 3, the load length ratio Rmr(30) can be easily increased.

Next, preferable average crystal grain sizes and preferable grain size distributions of the silicon crystal grains 1 and 2 on the slide surface 101 will be described. The inventors have conducted a detailed study on the relationship between the specific deployment of the silicon crystal grains 1 and 2 on the slide surface 101 and the abrasion resistance and strength of the cylinder block 100. As a result, it has been found that the abrasion resistance and strength can be greatly improved by setting the average crystal grain sizes of the silicon crystal grains 1 and 2 within specific ranges, and/or prescribing specific grain size distributions for the silicon crystal grains 1 and 2.

First, by setting the average crystal grain size of the primary-crystal silicon grains 1 to be within the range of no less than about 12 μm and no more than about 50 μm, the abrasion resistance of the cylinder block 100 can be improved.

If the average crystal grain size of the primary-crystal silicon grains 1 exceeds about 50 μm, the number of primary-crystal silicon grains 1 per unit area of the slide surface 101 becomes small. Therefore, a large load will be applied to each primary-crystal silicon grain 1 during operation of the internal combustion engine, so that the primary-crystal silicon grains 1 may be destroyed. The debris of the destroyed primary-crystal silicon grains 1 will act as abrasive particles, possibly causing a considerable abrasion of the slide surface 101.

If the average crystal grain size of the primary-crystal silicon grains 1 is less than about 12 μm, the portion of each primary-crystal silicon grain 1 that is buried within the matrix 3 will be small. Therefore, drop-off of the primary-crystal silicon grains 1 is likely to occur during operation of the internal combustion engine. The primary-crystal silicon grains 1 having dropped off will act as abrasive particles, possibly causing a considerable abrasion of the slide surface 101.

On the other hand, when the average crystal grain size of the primary-crystal silicon grains 1 is no less than about 12 μm and no more than about 50 μm, a sufficient number of primary-crystal silicon grains 1 exist per unit area of the slide surface 101. Therefore, the load applied to each primary-crystal silicon grain 1 during operation of the internal combustion engine will be relatively small, whereby destruction of the primary-crystal silicon grains 1 is suppressed. Since the portion of each primary-crystal silicon grain 1 that is buried within the matrix 3 is sufficiently large, drop-off of the primary-crystal silicon grains 1 is reduced, whereby the abrasion of the slide surface 101 due to primary-crystal silicon grains 1 having dropped off is also suppressed.

Moreover, the eutectic silicon grains 2 serve the function of reinforcing the matrix 3. Therefore, by providing fine eutectic silicon grains 2, the abrasion resistance and strength of the cylinder block 100 can be improved. Specifically, by ensuring that the eutectic silicon grains 2 have an average crystal grain size of about 7.5 μm or less, an effect of improving the abrasion resistance and strength is obtained.

Figure 21:
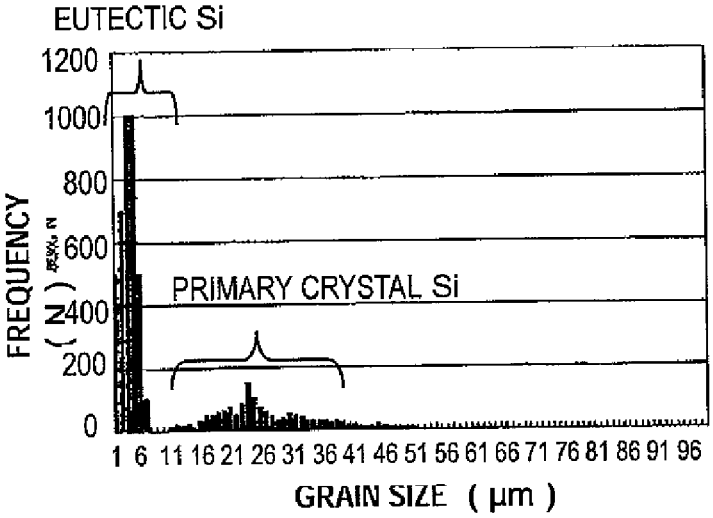
FIG. 21 is a graph showing an example of a preferable grain size distribution of silicon crystal grains.

Furthermore, by prescribing grain size distributions for the silicon crystal grains 1 and 2 such that the silicon crystal grains have a peak in a crystal grain size range of no less than about 1 μm and no more than about 7.5 μm and that the silicon crystal grains have a peak in a crystal grain size range of no less than 12 μm and no more than about 50 μm, the abrasion resistance and strength of the cylinder block 100 can be greatly improved. FIG. 21 shows an example of preferable grain size distributions. The silicon crystal grains whose crystal grain sizes fall within the range of no less than about 1 μm and no more than about 7.5 μm are eutectic silicon grains 2, whereas the silicon crystal grains whose crystal grain sizes fall within the range of no less than about 12 μm and no more than about 50 μm are primary-crystal silicon grains 1. Moreover, from the standpoint of allowing more eutectic silicon grains 2 to contribute to creation of oil puddles 4, as is also shown in FIG. 21, it is preferable that the frequency at a first peak existing in the crystal grain size range of no less than about 1 μm and no more than about 7.5 μm (i.e., the peak associated with the eutectic silicon grains 2) is at least about five times greater than the frequency at a second peak existing in the crystal grain size range of no less than about 12 μm and no more than about 50 μm (i.e., the peak associated with the primary-crystal silicon grains 1).

In order to control the average crystal grain sizes of the primary-crystal silicon grains 1 and the eutectic silicon grains 2, the cooling rate of the portion to become the slide surface 101 may be adjusted in the step of casting the molding (the step S1*c* shown in FIG. 5). Specifically, by performing the aforementioned casting so that the portion to become the slide surface 101 is cooled at a cooling rate of no less than about 4° C./second and no more than about 50° C./second, the silicon crystal grains 1 and 2 will be deposited in such a manner that the primary-crystal silicon grains 1 have an average crystal grain size of no less than about 12 μm and no more than about 50 μm and that the eutectic silicon grains 2 have an average crystal grain size of about 7.5 μm or less.

As described above, the cylinder block 100 of the present preferred embodiment includes the slide surface 101 having an excellent lubricant retaining ability, and therefore can be suitably used in the internal combustion engines of various types of transportation apparatuses. In particular, the cylinder block 100 is suitably used in any internal combustion engine that is operated at a high revolution speed (specifically, under a maximum revolution speed of 8000 rpm or more), e.g., an internal combustion engine of a motorcycle, whereby the durability of the internal combustion engine can be greatly improved.

Figure 22:
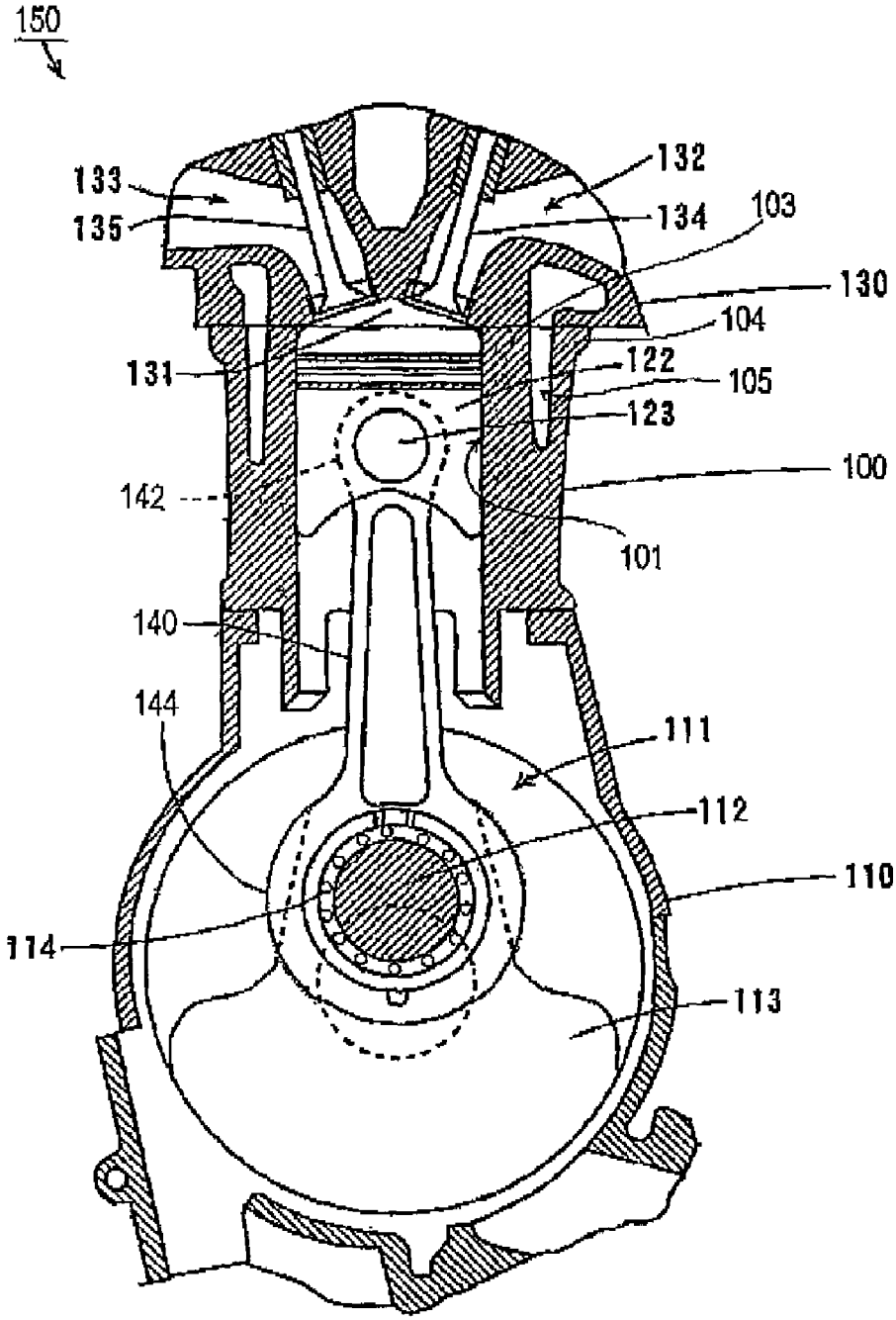
FIG. 22 is a cross-sectional view schematically showing an internal combustion engine including the cylinder block of FIG. 1.

FIG. 22 shows an exemplary internal combustion engine 150 incorporating the cylinder block 100 according to a preferred embodiment of the present invention. The internal combustion engine 150 includes a crankcase 110, a cylinder block 100, and a cylinder head 130.

A crankshaft 111 is accommodated within the crankcase 110. The crankshaft 111 includes a crankpin 112 and a crank web 113.

The cylinder block 100 is provided above the crankcase 110. A piston 122 is inserted in a cylinder bore of the cylinder block 100. The piston 122 is formed of an aluminum alloy (typically, a silicon-containing aluminum alloy). The piston 122 can be formed by forging, as is disclosed in, e.g., the specification of U.S. Pat. No. 6,205,836. The disclosure of the specification of U.S. Pat. No. 6,205,836 is incorporated herein in its entirety by reference.

No cylinder sleeve is inserted in the cylinder bore, and no plating is provided on the inner surface of the cylinder bore wall 103 of the cylinder block 100. In other words, the primary-crystal silicon grains 1 and the eutectic silicon grains 2 are exposed on the surface of the cylinder bore wall 103.

A cylinder head 130 is provided above the cylinder block 100. Together with the piston 122 in the cylinder block 100, the cylinder head 130 defines a combustion chamber 131. The cylinder head 130 includes an intake port 132 and an exhaust port 133. An intake valve 134 for supplying air-fuel mixture into the combustion chamber 131 is provided in the intake port 132, and an exhaust valve 135 for performing evacuation of the combustion chamber 131 is provided in the exhaust port 133.

The piston 122 and the crankshaft 111 are linked via a connecting rod 140. Specifically, a piston pin 123 of the piston 122 is inserted in a throughhole in a small end 142 of the connecting rod 140, and the crankpin 112 of the crankshaft 111 is inserted in a throughhole in a big end 144, whereby the piston 122 and the crankshaft 111 are linked to each other. Roller bearings 114 are provided between the inner peripheral surface of the throughhole of the big end 144 and the crankpin 112.

The internal combustion engine 150 shown in FIG. 22 has excellent durability because the cylinder block 100 of the present preferred embodiment is incorporated, although lacking an oil pump for compulsorily supplying a lubricant. Since the cylinder block 100 of the present preferred embodiment is characterized by a high abrasion resistance of the slide surface 101, there is no need for a cylinder sleeve. Therefore, the production steps of the internal combustion engine 150 can be simplified, the weight of the internal combustion engine 150 can be reduced, and the cooling performance can be improved. Furthermore, since it is unnecessary to perform plating for the inner surface of the cylinder bore wall 103, it is also possible to reduce production cost.

Figure 23:
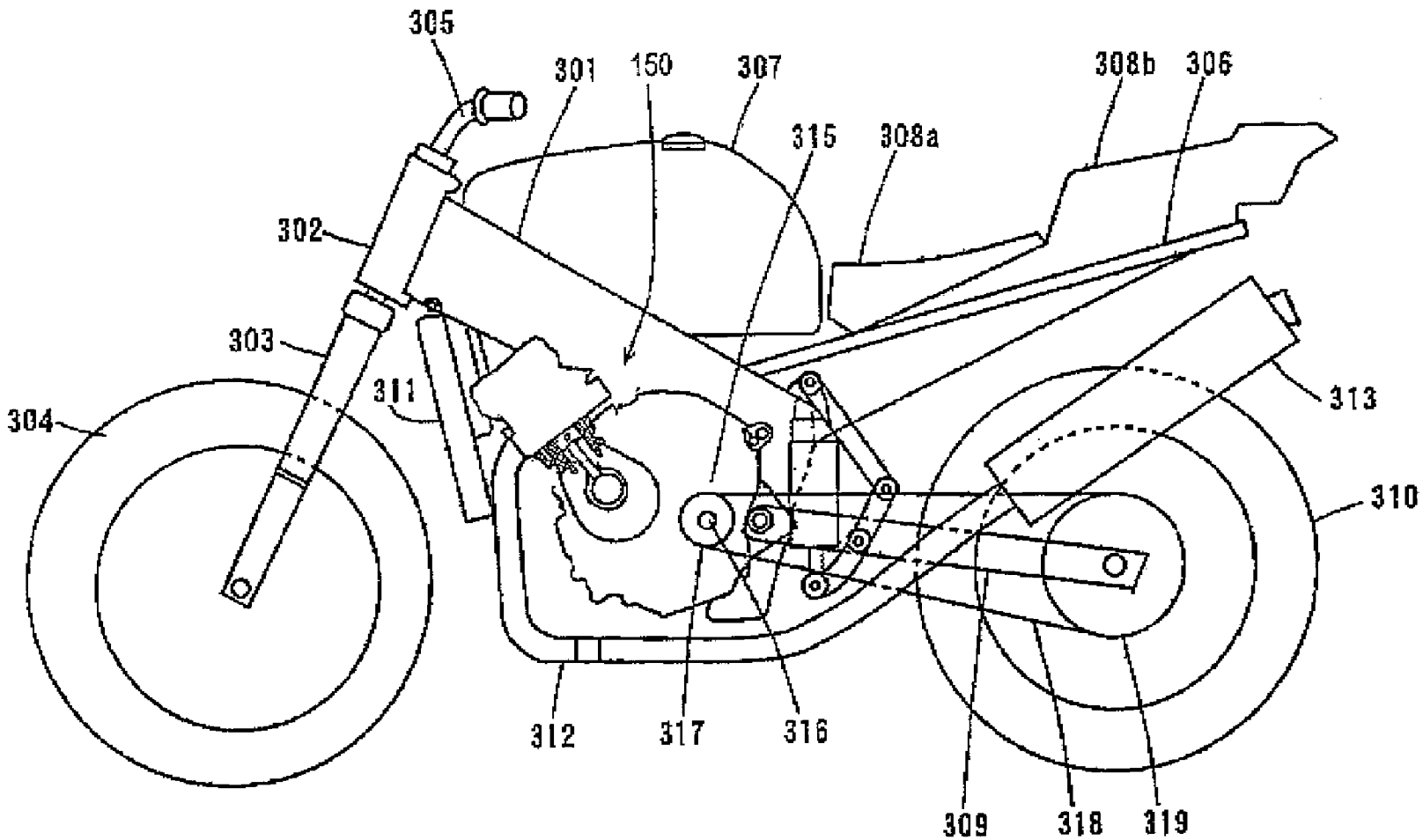
FIG. 23 is a side view schematically showing a motorcycle incorporating the internal combustion engine shown in FIG. 22.

FIG. 23 shows a motorcycle which incorporates the internal combustion engine 150 shown in FIG. 22. In a motorcycle, the internal combustion engine 150 will be operated at a high revolution speed.

In the motorcycle shown in FIG. 23, a head pipe 302 is provided at the front end of a body frame 301. To the head pipe 302, a front fork 303 is attached so as to be capable of swinging in the right-left direction of the vehicle. At the lower end of the front fork 303, a front wheel 304 is supported so as to be capable of rotating.

A seat rail 306 is attached at an upper portion of the rear end of the body frame 301 so as to extend in the rear direction. A fuel tank 307 is provided on the body frame 301, and a main seat 308*a* and a tandem seat 308*b* are provided on the seat rail 306.

Rear arms 309 extending in the rear direction are attached to the rear end of the body frame 301. At the rear end of the rear arms 309, a rear wheel 310 is supported so as to be capable of rotating.

At the central portion of the body frame 301, the internal combustion engine 150 shown in FIG. 22 is held. The cylinder block 100 of the present preferred embodiment is used for the internal combustion engine 150. A radiator 311 is provided in front of the internal combustion engine 150. An exhaust pipe 312 is connected to an exhaust port of the internal combustion engine 150, and a muffler 313 is attached to the rear end of the exhaust pipe 312.

A transmission 315 is linked to the internal combustion engine 150. Driving sprockets 317 are attached on an output axis 316 of the transmission 315. Via a chain 318, the driving sprockets 317 are linked to rear wheel sprockets 319 of the rear wheel 310. The transmission 315 and the chain 318 function as a transmitting mechanism for transmitting the motive power generated in the internal combustion engine 150 to the driving wheel.

Since the motorcycle shown in FIG. 23 incorporates the internal combustion engine 150, in which the cylinder block 100 of the present preferred embodiment is used, the motorcycle has excellent performance.

Although the present preferred embodiment has been illustrated with respect to a cylinder block as an example, the present invention is not limited thereto. The present invention is broadly applicable to any internal combustion engine component having a slide surface (that is, a lubricant needs to be retained on the surface). For example, the present invention can be used for a piston, a cylinder sleeve, or a cam piece.

According to preferred embodiments of the present invention, there is provided an internal combustion engine component having a slide surface with an excellent lubricant retaining ability, as well as a method for producing the same.

The internal combustion engine component according to preferred embodiments of the present invention can be suitably used in the internal combustion engines for various types of transportation apparatuses, and can be particularly suitably used for internal combustion engines which are operated at high revolutions and for internal combustion engines in which lubricant is not compulsorily supplied to a cylinder via a pump.

While the present invention has been described with respect to preferred embodiments thereof, it will be apparent to those skilled in the art that the disclosed invention may be modified in numerous ways and may assume many embodiments other than those specifically described above. Accordingly, it is intended by the appended claims to cover all modifications of the invention that fall within the true spirit and scope of the invention.

The invention claimed is:

1. An internal combustion engine component composed of an aluminum alloy containing silicon, comprising:

a plurality of silicon crystal grains located on a slide surface; wherein the slide surface has a ten point-average roughness $Rz_{JIS}$ of about 0.54 μm or more, and a load length ratio Rmr(30) at a cut level of about 30% of the slide surface is about 20% or more.

2. The internal combustion engine component of claim 1, wherein the plurality of silicon crystal grains include a plurality of primary-crystal silicon grains and a plurality of eutectic silicon grains.

3. The internal combustion engine component of claim 2, wherein the plurality of primary-crystal silicon grains have an average crystal grain size of no less than about 12 μm and no more than about 50 μm.

4. The internal combustion engine component of claim 2, wherein the plurality of eutectic silicon grains have an average crystal grain size of about 7.5 μm or less.

5. The internal combustion engine component of claim 1, wherein the plurality of silicon crystal grains have a grain size distribution having a first peak existing in a crystal grain size range of no less than about 1 μm and no more than about 7.5 μm and a second peak existing in a crystal grain size range of no less than about 12 μm and no more than about 50 μm.

6. The internal combustion engine component of claim 5, wherein a frequency at the first peak is at least about five times greater than a frequency at the second peak.

7. The internal combustion engine component of claim 1, wherein the aluminum alloy contains: no less than about 73.4 mass % and no more than about 79.6 mass % of aluminum; no less than about 18 mass % and no more than about 22 mass % of silicon; and no less than about 2.0 mass % and no more than about 3.0 mass % of copper.

8. The internal combustion engine component of claim 1, wherein the aluminum alloy contains no less than about 50 mass ppm and no more than about 200 mass ppm of phosphorus and no more than about 0.01 mass % of calcium.

9. The internal combustion engine component of claim 1, wherein the internal combustion engine component is a cylinder block.

10. An internal combustion engine comprising the internal combustion engine component of claim 1.

11. The internal combustion engine of claim 10, wherein the internal combustion engine comprises a piston composed of an aluminum alloy, and the internal combustion engine component is a cylinder block.

12. A transportation apparatus comprising the internal combustion engine of claim 10.

* * * * *